United States Patent [19]

Tracy

[11] 4,185,408

[45] Jan. 29, 1980

[54] BACK-LIGHTED SIGNBOARD

[76] Inventor: Charles H. Tracy, 16515 Kingswood Dr., Lakeville, Minn. 55044

[21] Appl. No.: 834,490

[22] Filed: Sep. 19, 1977

[51] Int. Cl.[2] ..... G09F 13/04

[52] U.S. Cl. ..... 40/564; 40/603; 40/624

[58] Field of Search ..... 40/541, 571, 603, 604, 40/607, 606, 611, 617, 624, 152.1, 152.2, 156, 367, 361, 564

[56] References Cited

U.S. PATENT DOCUMENTS

| | | | |
|---|---|---|---|
| 3,160,973 | 12/1964 | Ruppelt et al. | 40/624 |
| 3,726,035 | 4/1973 | Bower et al. | 40/604 |
| 3,862,504 | 1/1975 | Ringelheim et al. | 40/437 |
| 3,934,365 | 1/1976 | Stein et al. | 40/603 |

FOREIGN PATENT DOCUMENTS

| | | | |
|---|---|---|---|
| 1077840 | 11/1954 | France | 40/603 |
| 1579199 | 8/1969 | France | 40/367 |
| 56417 | 4/1924 | Sweden | 40/624 |

*Primary Examiner*—John F. Pitrelli
*Attorney, Agent, or Firm*—Paul L. Sjoquist

[57] ABSTRACT

Apparatus for mounting signboard paper in large sheets or in elongated strips, and for holding the signboard paper in tension over a slightly curved board transparent surface, and including moveable tensioning devices.

7 Claims, 6 Drawing Figures

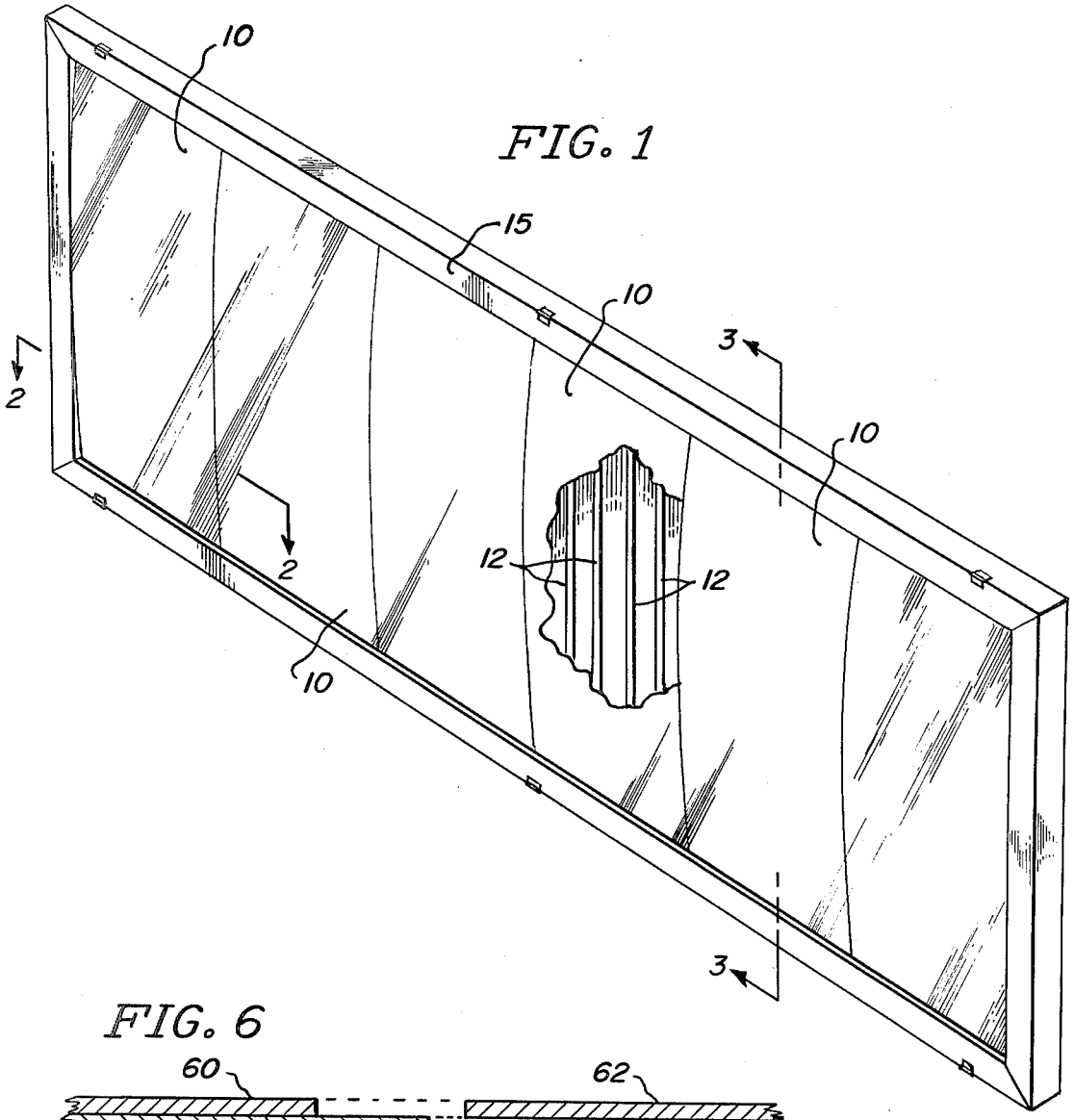
FIG. 1
FIG. 6
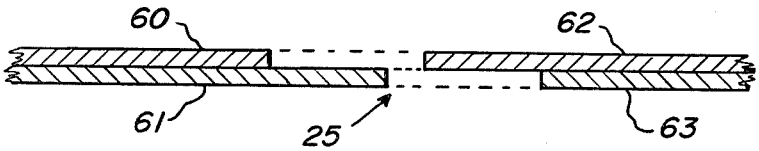
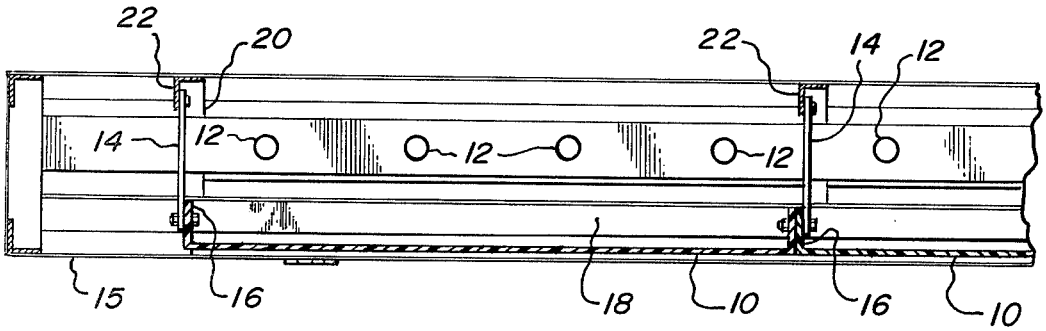
FIG. 2

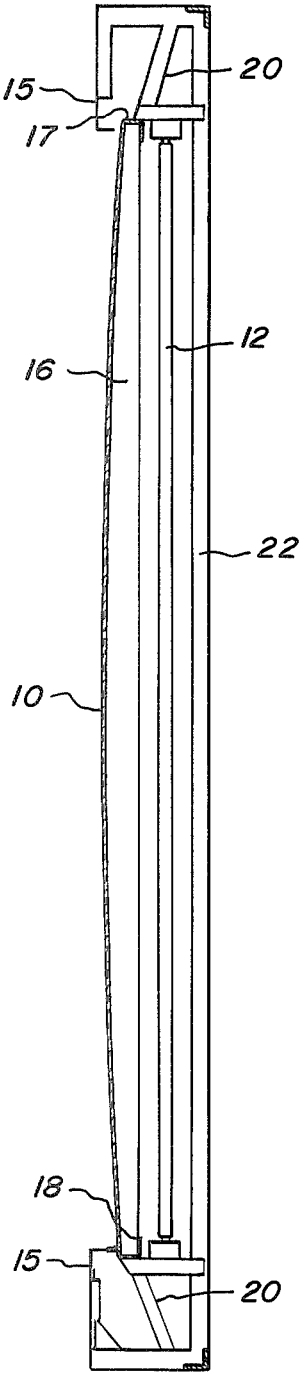
FIG. 3
FIG. 4
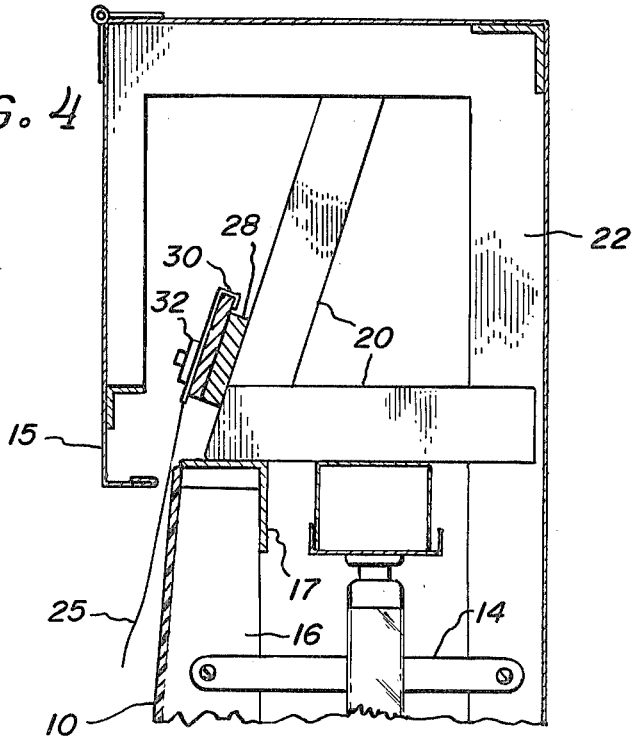
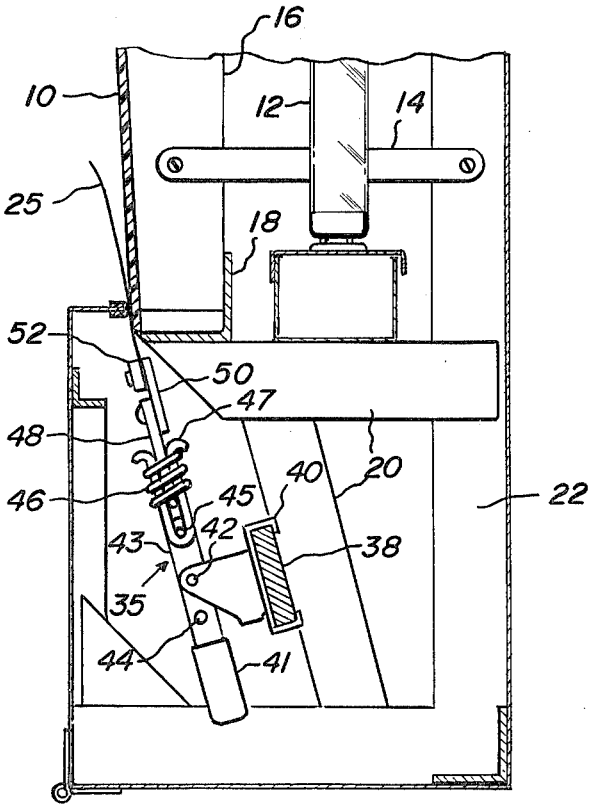
FIG. 5

BACK-LIGHTED SIGNBOARD

BACKGROUND OF THE INVENTION

The present invention relates to apparatus for displaying sign posters, and particularly outdoor advertising posters wherein the display is of relatively large area. Outdoor advertising billboards typically range in size from about eight feet by ten feet to sizes in excess of twenty feet by eighty feet. According to the state of the art relating to advertising billboards in the size range of up to twelve feet by twenty-four feet, the material which is displayed thereon is typically printed in advance in sections, and the sections are pasted to the board and pieced together by a skilled craftsman, who is trained in handling fairly large sections of an outdoor advertising poster and in properly registering the sections together. Billboards larger than about twelve feet by twenty-four feet are typically hand painted by skilled painters.

The lighting of large outdoor advertising billboards for nighttime display is accomplished by lighting fixtures which project forwardly from the poster, either from a top or bottom edge, so that the light fixture is directed toward the poster for front lighting illumination. The state of the art in outdoor advertising has not yet permitted a satisfactory billboard with rear illumination. Of course, small size advertising posters, of up to several feet on a side, have been developed using photographic enlarging techniques wherein an enlargement is photographically placed on a film surface and the film surface is mounted on a transparent surface and is illuminated by means of light from the rear. While these small, photographically enlarged posters create a striking and dramatic effect, it has not yet been possible to extend the technology to commercial billboard sizes such as are typically found along highways and streets.

If ordinary billboard techniques are utilized in attempting to create a back-lighted, large billboard, the imperfect alignment of adjacent sections of the large poster create light cracks or opaque strips which detract from the quality of the piece. There has heretofore been no known effective way to solve the problem of registering sectional pieces of a larger billboard poster in a manner which permits backlighting and avoids the adverse effects of poor registration over mating sections of the poster.

SUMMARY OF THE INVENTION

The present invention enables a billboard to be constructed in extremely large sizes, either with sectional poster material properly registered so that backlighting may be accomplished without any adverse registration light problems or by using single large transparent sheets. The invention comprises a curved transparent billboard surface, and tensioning devices aligned along the respective edges of the billboard for grasping the poster edge and holding the edge in tension alignment over the curved transparent surface, and means for aligning the tensioning devices relative to one another so as to provide horizontal registration means for aligning elongated poster strips. The apparatus further comprises backlighting means, and means for servicing the apparatus through access entries in front and in the rear.

BRIEF DESCRIPTION OF THE DRAWINGS

The invention will be understood with reference to the specification and drawings appended hereto, in which:

FIG. 1 illustrates a front perspective view of the present invention in partial cutaway; and FIG. 2 illustrates a view taken along the lines 2—2 of FIG. 1; and FIG. 3 is a side view cross-section of the invention taken along the lines 3—3 of FIG. 1; and FIG. 4 is a side view of an upper portion of the invention showing the slide carrier mechanism; and FIG. 5 illustrates a side view of a portion of the invention, showing a lower tensioning apparatus; and FIG. 6 shows, in partial cross-section greatly magnified, an end view of two poster strips.

DESCRIPTION OF THE PREFERRED EMBODIMENT

Referring first to FIG. 1, a billboard having the features disclosed herein is illustrated. Typically, the billboard of FIG. 1 may measure eight feet or greater in height and twenty feet or greater in width. The front surface 10 of the billboard is light transparent and is typically manufactured from a material such as plexiglass. A portion of FIG. 1 is cut away so as to illustrate the apparatus behind transparent surface 10. A plurality of fluorescent lamps 12 are aligned in spaced-apart parallel position across the entire billboard length. Fluorescent lamps 12 are connected to suitable electrical connectors at their respective ends, and are spaced apart to provide the appropriate degree of backlighting which is desired in any particular billboard application. For example, in a billboard of dimension 9'×21', it may be found acceptable to space lamps 12 about ten inches apart across the entire billboard width. This has been found to produce sufficient backlighting to adequately illuminate a poster which is applied against the outside of transparent surface 10. A plurality of service doors may be provided in the rear of the billboard assembly in order that maintenance and service can be effectively accomplished through access to the rear of the billboard. An edge border 15 completely covers the perimeter of the billboard, overlapping transparent surface 10 so as to create a framing effect around the entire transparent surface 10.

Transparent surface 10 is comprised of a plurality of transparent panels which are aligned edgewise to construct the entire transparent surface. In aligning these transparent panels it is necessary to closely contact adjacent edge surfaces so as to eliminate any line which might otherwise be illuminated by the backlighting. To minimize this problem, the corresponding mating edges of various transparent panels are very carefully smoothed and mated to the adjacent panel, so that any light transmitted through the transparent material will pass readily into the adjacent transparent material without creating the edge-lighted effect which is so well known in the fiber optic field. A supporting transparent member 16 (FIG. 3) is positioned and bonded along the rear mating junction of adjacent transparent panels so as to minimize this "light pipe" effect, as well as to properly hold the respective transparent panels in predetermined curved relationship.

FIG. 2 illustrates a cross-section view of the billboard apparatus taken along the lines 2—2 of FIG. 1. Transparent surface 10 is supported over a curved arc for reasons which will be hereinafter described. This curved arc is developed by the plurality of panel support members 16 which are supported by frame 20. Frame 20 consists of welded channel iron support members which together provide the rigid mechanical support required for the proper construction of the invention. Vertical frame members 22 extend between and support the respective end frames 20. Panel support members 16 are preferably constructed from a transparent material such as plexiglass and bonded to the rear side of transparent surface 10. Support members 16 are attached to vertical frame members 22 by means of brackets 14 and suitable bolts.

FIG. 3 illustrates a vertical cross-sectional view taken along lines 3—3 of FIG. 1. Transparent panel support members 16 are attached at their top and bottom ends to end frame members 20 by means of supporting angle brackets 17 and 18 respectively. Angle brackets 17 and 18 are rigidly attached to their respective frame members so as to form a rugged, strong support for transparent surface 10. Likewise, lamps 12 are secured via their electrical outlets between end frame members 20 to provide a rigid mounting structure.

FIG. 4 illustrates an expanded cross-section view of the top portion of the invention. A guide rail 28 is horizontally mounted across the top edge of the billboard, concealed behind edge border 15 and attached rigidly to frame member 20. Guide rail 28 provides a horizontal reference line across which the poster 25 is referenced relative to the billboard. When multiple poster sections are used guide rail 28 also provides a horizontal reference for ensuring vertical registration of the poster sections which are to be mounted on the billboard. A slide member 30 has a hooked end for hooking guide rail 28, which hooked end may be freely moved in a lateral or horizontal direction. Slide 30 has a clamp 32 for clamping the edge of poster 25 tightly and securely to slide 30. Preferably, slide 30 is attached to the edge of the poster 25 at the factory, care being taken to ensure perfect vertical registration of the poster prior to clamping the poster by means of clamp 32. Since slide 30 is properly horizontally positioned along the guide rail 28, horizontal and vertical registration of the poster on the billboard is thereby assured.

FIG. 5 illustrates an expanded cross-section of the lower portion of the view of FIG. 3. A guide rail 38 is horizontally aligned and rigidly attached to end frame members 20 across the entire lower billboard section. Slide 40 is slidably attached to guide rail 38 for free movement in the horizontal direction. Attached to slide 40 is at least one spring-tensioning device 35, of a type known in the art, for every 48 inches of width of slide 40. Spring-tensioner 35 has a handle 41 which is pivotal about a pin 42. A draw bar 43 is pivotally connected to handle 41 at pin 44. Draw bar 43 has a transverse pin 45 which hooks U-shaped member 47. A second, similarly shaped and inverted U-shaped member 48 is perpendicularly aligned within member 47, and a compression spring 46 is coupled between the members. U-shaped member 48 is bolted or riveted to a plate 50, which plate 50 is attached to poster 25 by means of a clamp 52.

Tensioning device 35 exerts a downward tensioning force against poster 25 whenever handle 41 is latched downwardly because of the over-center latching configuration of tensioning device 35. Handle 41 may be moved outwardly and upwardly to relieve the tension against poster 25. Preferably, the bottom edge of the poster is rigidly clamped by means of clamp 52 and plate 50, and a tensioning device 35 is attached at spaced intervals, by bolting a U-shaped member 48 along the length of plate 50. In the case of posters made in sections, it is possible to utilize a single tensioning device 35 for each poster section by bolting to the center of a plate 50 attached to the section. Plate 50 and clamp 52 are preferably attached to the poster edges at the factory, and are properly oriented so as to be horizontally aligned with the poster, and parallel to the attached slide and clamp at the top poster section edge. By carefully attaching plate 50 and clamp 52 the appropriate amount of downward tensioning force may be applied against the edges of poster 25 at the time it is connected to tensioning device 35. The amount of poster tensioning force desired may also be selected by the appropriate choice of compression spring 46, as well as by selecting the length of the lever arm between pins 42 and 44.

FIG. 6 illustrates in end cross-section view, greatly enlarged, a portion of adjacent sections of a poster 25 which is formed in sections. Each section of poster 25 consists of two laminated layers, as for example layers 60 and 61 of FIG. 6. Each layer has photographically or by other image making process reproduced thereon the desired poster image, although the respective images are offset relative to the vertical edge of the poster section. During the manufacturing process, and before lamination, the respective poster images are horizontally registered, one atop the other, so as to form a single image when lighted from the rear. This registration leaves an overlap of layer 61 projecting outwardly from layer 60 along one vertical edge, and an overlap of layer 60 projecting outwardly from layer 61 along the other vertical edge. Layers 62 and 63 are similarly formed for the next adjacent poster section, leaving the image on layer 62 with an overlap projecting outwardly from layer 63. When these adjacent poster sections are horizontally fitted together, as indicated by the dotted lines of FIG. 6, a registration is obtained between the image on projecting layer 62 and the image on projecting layer 61. Because of the projecting overlap between respective adjacent sections no light crack occurs between these sections, even if they are slightly separated to obtain perfect image registration.

In operation, as has been hereinbefore stated, each poster is properly fitted at the factory with an upper and lower clamping means, slide 30 being properly clamped along the top edge of the poster and plate 50 being properly clamped along the bottom edge. The poster is then transported to the billboard site and is attached along guide rail 28. Bottom plates 50 are loosely attached to spring tensioners 35, with the spring tensioners in their open or non-tensioning positions.

For very large billboards it has been convenient to add vertical channels (not shown) along the vertical sides of the billboard adjacent transparent surface 10, which facilitate the procedure for mounting a poster on the billboard. In these cases the slide 30 is fitted with guide members at its respective ends, which guide members fit into the vertical channels to guide the poster as it is raised into position over transparent surface 10. The guide members may be pins or rollers, in any particular installation, which move freely along the vertical channel while holding the poster relatively close to transparent surface 10. This prevents wind gusts from affecting poster position during the installation procedure. A similar guide mechanism can be attached to the bottom poster edge during installation to control movement of the bottom portion of the poster.

The poster section is properly horizontally aligned and its spring tensioning device is closed, exerting a tensioning force to the poster section and securely holding it against transparent surface 10. Because this tensioning force is exerted along an arcuate path, due to the relative positions of the end clamps as well as the curved shape of transparent surface 10, the poster section is securely held against transparent surface 10.

If multiple poster sections are to be mounted on the billboard each adjacent poster section is horizontally aligned by moving slide 30 and 40, and the image of the poster section is brought into registration with the projecting laminate edge of the adjacent fixed poster section. When image registration is achieved the tensioning devices associated with this poster section are clamped closed and the poster section is secured against transparent surface 10. This procedure is followed for each of the poster sections across the billboard, to place each section in exact registration with its adjacent section, and when all sections have been so secured there appears a back-lighted image having good image resolution and registration without any light cracks visable through the poster.

The foregoing invention provides the appearance of an extremely large, cohesive, and unified image across the entire billboard surface. To remove the poster from the billboard, all that is necessary is to release the respective tensioning devices and disconnect them from the poster bottom plates, and to remove the slides from their respective guide rails. Mounting and removing a poster from a billboard in this fashion results in an extremely fast and precise operation, and one which may be accomplished without special training or skills. Further, since no liquid adhesives are required at the billboard site the job may be accomplished at any temperature and under most weather conditions.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A back-lighted billboard for day and night display of large posters adapted for installation on the billboard, comprising:

(a) a billboard frame assembly for providing a structural support member for said billboard;

(b) a plurality of spaced light sources mounted on said billboard frame assembly;

(c) a transparent poster support surface mounted on said billboard frame assembly in front of said spaced light sources and having a convex outer curvature;

(d) means for attaching a poster edge proximate a first horizontal edge of said transparent poster support surface, said means including detachable means for attaching to said poster edge extending along and proximate to said first horizontal edge;

(e) tensioning means for tensioning said poster over said transparent poster surface, said tensioning means being attached to said billboard frame assembly proximate a second horizontal edge of said transparent poster support surface, and including a plurality of adjustable spring tensioning devices attachable to said posters.

2. The apparatus of claim 1, wherein each of said spring tensioning devices further comprises a two-position handle locking mechanism wherein a first spring force tension is exerted in one handle position and a second spring force tension is exerted in a second handle position.

3. A display apparatus for holding large sign posters formed from a plurality of image-registered strip sections, comprising (a) a rectangular frame assembly;

(b) a light-transparent sheet mounted within said frame assembly in an outward-bowed position;

(c) a plurality of light source mounted within said frame assembly in spaced relationship behind said light-transparent sheet;

(d) means for attaching first poster edges, mounted on said frame assembly proximate a first upper edge of said light-transparent sheet, and comprising a horizontal support extending across said frame assembly and a plurality of connectors adapted to attach said poster to said horizontal support and permit horizontal motion of said poster; and (e) means for attaching second poster edges, comprising a plurality of poster tensioning devices attached along a second lower edge of said light-transparent sheet, each of said tensioning devices adapted to connect to a lower poster edge.

4. The apparatus of claims 3, wherein each of said poster tensioning devices further comprises a spring-loaded latch arm having at least two tensioning positions.

5. The apparatus of claim 3, wherein said light-transparent sheet is mounted in an outward-bowed position of at least two inches deflection.

6. The apparatus of claim 3, wherein said plurality of light sources further comprise a plurality of fluorescent lamps.

7. The apparatus of claim 3, further comprising a border assembly attached to said frame assembly and extending around the perimeter of said frame assembly, said border assembly extending to at least cover said means for attaching first and second poster edges.

* * * * *